US008668068B2

(12) United States Patent
Nakagawa et al.

(10) Patent No.: US 8,668,068 B2
(45) Date of Patent: Mar. 11, 2014

(54) COIN HANDLING APPARATUS, COIN HANDLING METHOD AND COIN HANDLING SYSTEM

(75) Inventors: Keiju Nakagawa, Tatsuno (JP); Minoru Higashiyama, Himeji (JP); Hideki Takahashi, Ichikawa (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 0 days.

(21) Appl. No.: 13/523,984

(22) Filed: Jun. 15, 2012

(65) Prior Publication Data

US 2013/0037376 A1 Feb. 14, 2013

(30) Foreign Application Priority Data

Jun. 16, 2011 (JP) ..... 2011-134297

(51) Int. Cl.
*G07D 9/00* (2006.01)
*G07D 11/00* (2006.01)

(52) U.S. Cl.
USPC ..... 194/215

(58) Field of Classification Search
USPC ..... 194/215, 353; 453/58, 63; 235/375, 235/379; 700/215, 221, 224–226; 902/11, 902/14; 705/35, 37
See application file for complete search history.

(56) References Cited

U.S. PATENT DOCUMENTS 5,813,510 A * 9/1998 Rademacher ..... 194/206

* cited by examiner

*Primary Examiner* — Mark Beauchaine
(74) *Attorney, Agent, or Firm* — Renner, Kenner, Greive, Bobak, Taylor & Weber

(57) ABSTRACT

The coin handling apparatus configured to handle the first coin of the first nation and the second coin of the second nation includes a recognition unit 48 configured to recognize a coin and detects a feature amount of the recognized coin. The recognition unit 48 is configured to regard the recognized coin as the first coin when the feature amount of the detected coin conforms to feature amount information including a feature amount of the first coin and a feature amount of the second coin.

12 Claims, 6 Drawing Sheets

COIN HANDLING APPARATUS, COIN HANDLING METHOD AND COIN HANDLING SYSTEM

CROSS REFERENCE TO RELATED APPLICATIONS

This application is based upon and claims the benefit of priority from the prior Japanese Patent Application No. 2011-134297 filed on Jun. 16, 2011, the entire contents of which are incorporated herein by reference.

FIELD OF THE INVENTION

The present invention relates to a coin handling apparatus, a coin handling method and a coin handling system for handling coins of a plurality of nations.

BACKGROUND ART

Various types of coin handling apparatuses configured to perform various processes such as a coin depositing process and a coin dispensing process have been conventionally known. Specifically, as a coin handling apparatus for handling a coin, apparatuses disclosed in, e.g., JP2009-75749A and JP2011-59835A have been known. JP2009-75749A discloses a coin depositing and dispensing machine installed together with a register. The machine deposits a coin received from a shopper, and dispenses a coin as change. Deposited coins are separately stored by denomination in the machine. In the coin depositing and dispensing machine disclosed in JP2009-75749A, when a coin other than a coin of a nation where the coin depositing and dispensing machine should be used, i.e., a foreign coin is deposited, such a coin is rejected as an unacceptable coin. On the other hand, in an automatic transaction apparatus disclosed in JP2011-59835A, when a foreign coin is deposited, the coin is accepted as a foreign coin.

DISCLOSURE OF THE INVENTION

In the United States of America and Canada, there is a case in which a foreign coin circulates as a coin having the same value as that of a domestic coin. To be specific, a one-cent coin of US currency and a one-cent coin of Canadian currency are similar to each other in size and color, and are not remarkably different from each other in value. Thus, in the USA, there is a case in which a one-cent coin of Canadian currency is received as a coin equivalent to a one-cent coin of US currency. Similarly, in Canada, there is a case in which a one-cent coin of US currency is received as a coin equivalent to a one-cent coin of Canadian currency. In addition, a ten-cent coin of US currency and a ten-cent coin of Canadian currency are similar to each other in size and color, and are not remarkably different from each other in value. Similarly, a quarter-cent coin of US currency and a quarter-cent coin of Canadian currency are similar to each other in size and color, and are not remarkably different from each other. Thus, there is a case in which a foreign coin circulates as a coin having the same value as that of a domestic coin. In this case, when a coin handling apparatus strictly differentiates a coin of US currency and a coin of Canadian currency from each other, a smooth transaction may be interrupted.

More specifically, in a case where a coin of US currency and a coin of Canadian currency circulate in a mixed manner on the assumption that the coins have the same value, when the coin depositing and dispensing machine available only for a domestic coin, which is shown in JP2009-75749A, is used, since the coin depositing and dispensing machine cannot accept a foreign coin but rejects the same, a smooth transaction is interrupted. On the other hand, as shown in JP2011-59835A, there exists a coin handling apparatus available for currencies of two nations. However, in such a coin handling apparatus, sums are separately calculated for the currencies of the two nations, e.g., rates of a plurality of nations are separately converted. Namely, the coin handling apparatus is not configured to handle coins of two nations as coins having the same value. Generally, the apparatus available for currencies of a plurality of nations, which is disclosed in JP2011-59835A, is provided with a conversion rate list between the currencies. The value of a conversion rate is varied depending on an exchange rate. Thus, in an actual transaction, when it is demanded that a shortfall, which is calculated as a result of a rate conversion by the coin handling apparatus, should be paid for a person who paid a foreign country as a coin having the same value as that of a domestic coin, a smooth transaction is interrupted.

The present invention has been made in view of the above circumstances. The object of the present invention is to provide a coin handling apparatus, a coin handling method and a coin handling system that make possible a smooth transaction even when a first coin of a first nation and a second coin of a second nation circulate on the assumption that the first coin and the second coin have the same value.

The first invention is a coin handling apparatus configured to handle a first coin which is a coin of a first nation and a second coin which is a coin of a second nation, the coin handling apparatus including: a recognition unit configured to recognize a coin and to detect a feature amount of the recognized coin, the recognition unit being configured to regard the recognized coin as the first coin, when a feature amount of the detected coin conforms to feature amount information including a feature amount of the first coin and a feature amount of the second coin.

The second invention is a coin handling apparatus configured to handle a first coin which is a coin of a first nation and a second coin which is a coin of a second nation, the coin handling apparatus including: a recognition unit configured to recognize the first coin and the second coin; and a control unit configured to count a coin based on a recognition result by the recognition unit, the control unit being configured to count a coin while regarding ail of the first coin and the second coin that have been recognized by the recognition unit as the first coin.

The third invention is a coin handling apparatus configured to handle a first coin which is a coin of a first nation and a second coin which is a coin of a second nation, the coin handling apparatus including: a recognition unit configured to recognize the first coin and the second coin; a setting unit configured to perform a setting such that a value of the first coin and a value of the second coin are regarded as an equivalent value; and a control unit configured to count a coin based on a recognition result by the recognition result, the control unit being configured to calculate a total value of the first coin and the second coin that have been recognized by the recognition unit in a currency unit of the first nation, based on the contents set by the setting unit.

In the first to third inventions, the coin handling apparatus may further include a mode switching unit capable of switching two process modes such that a coin is processed by either one of the process modes of a first process mode in which a value of the first coin and a value of the second coin are handled as an equivalent value, and a second process mode in which the first coin and the second coin are handled in a differentiated manner.

In the first to third inventions, the coin handling apparatus may further include a storing unit configured to store a coin, and the control unit is configured to perform a control such that, when a coin is stored in the coin handling apparatus, a coin recognized by the recognition unit as the first coin and a coin recognized by the recognition unit as a second coin are stored in the same storing unit in a mixed state.

In this case, when the first coin is dispensed from the coin handling apparatus, the first coin and the second coin, which are stored in the storing unit in a mixed state, may be dispensed as the first coin.

In the first to third inventions, the coin handling apparatus may further include a plurality of storing units configured to store coins by denomination, and the control unit is configured to perform a control such that, when a coin is stored in the coin handing apparatus, a coin recognized by the recognition unit as the first coin and a coin recognized by the recognition unit as the second coin are stored in the different storing units.

In this case, when the first coin is dispensed from the coin handling apparatus, the second coin stored in the storing unit may be dispensed.

The fourth invention is a coin handling apparatus configured to handle a first coin which is a coin of a first nation and a second coin which is a coin of a second nation, the coin handling apparatus further including a storing unit configured to store a coin, when a coin is stored in the coin handling apparatus, a coin is received such that a value of the first coin and a value of the second coin are regarded as an equivalent value; and when the first coin is dispensed from the coin handling apparatus, a coin in the storing unit storing at least partially the second coin is dispensed as the first coin.

The fifth invention is a coin handling apparatus configured to handle a first coin which is a coin of a first nation and a second coin which is a coin of a second nation, the coin handling apparatus including at least one storing unit configured to store the first coin and the second coin, and when the first coin is dispensed from the coin handling apparatus, a coin in the storing unit storing the second coin is dispensed as the first coin.

The sixth invention is a coin handling method for handling a first coin which is a coin of a first nation and a second coin which is a coin of a second nation, including: recognizing a coin and detecting a feature amount of the recognized coin; and regarding the recognized coin as the first coin, when the feature amount of the detected coin conforms to feature amount information including a feature amount of the first coin and a feature amount of the second coin.

The seventh invention is a coin handling method for handling a first coin which is a coin of a first nation and a second coin which is a coin of a second nation, including: recognizing the first coin and the second coin; and processing a coin while regarding all of the recognized first coin and the second coin as the first coin.

The eighth invention is a coin handling method for handling a first coin which is a coin of a first nation and a second coin which is a coin of a second nation, including: performing a setting such that a value of the first coin and a value of the second coin are regarded as an equivalent value; recognizing the first coin and the second coin; and calculating, in a currency unit of the first nation, a total value of the first coin and the second coin that have been recognized, based on the set contents.

The ninth invention is a coin handling method for handling a first coin which is a coin of a first nation and a second coin which is a coin of a second nation, including processing the second coin as a coin having a value equivalent to the first coin by a coin handling apparatus.

The tenth invention is a coin handling system including: a coin handling apparatus configured to handle a coin which is a coin of a first nation and a second coin which is a coin of a second nation; and a higher-level apparatus provided separately from the coin handling apparatus and connected for communication with the coin handling apparatus; and the coin handing apparatus includes a recognition unit configured to recognize the first coin and the second coin, and is configured to transmit respective recognition results of the first coin and the second coin obtained by the recognition unit to the higher-level apparatus; and the higher-level apparatus is configured to process a coin while regarding a value of the first coin and a value of the second coin as an equivalent value.

According to the coin handling apparatus, the coin handling method and the coin handling system of the present invention, even when a first coin of a first nation and a second coin of a second nation circulate on the assumption that the first coin and the second coin have the same value, a smooth transaction can be performed.

DETAILED DESCRIPTION OF THE INVENTION (First Embodiment)

Figure 1:
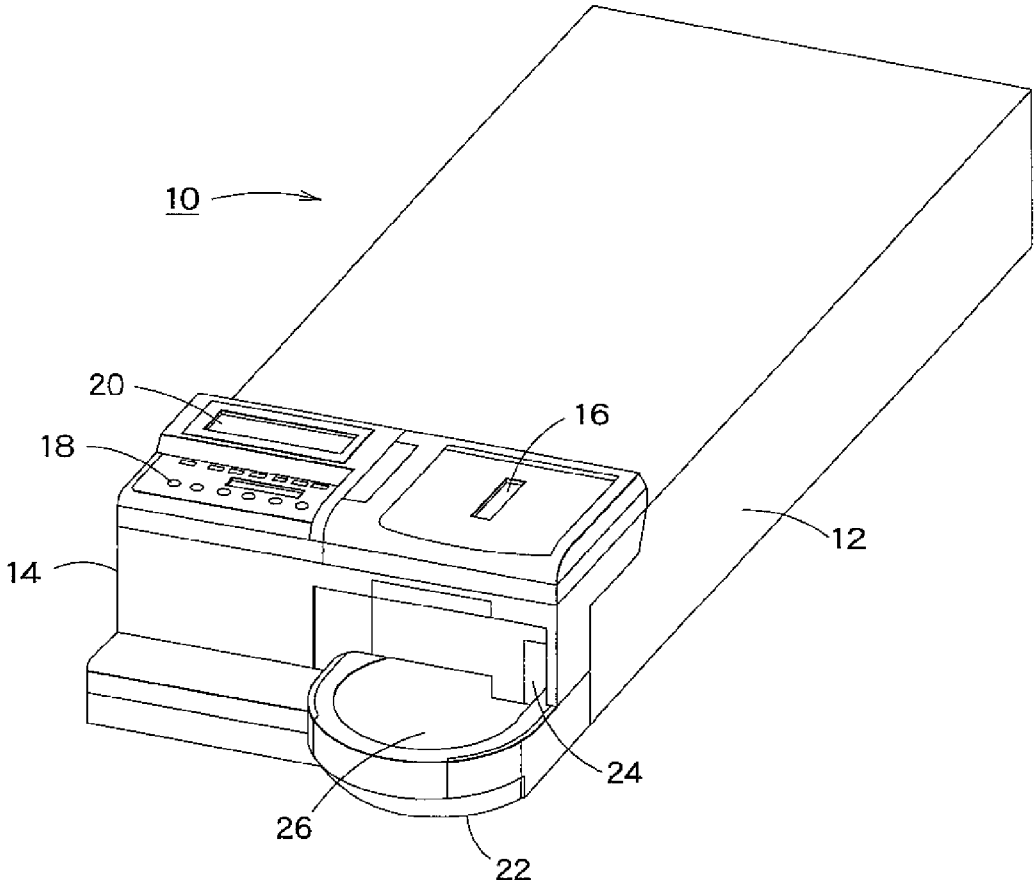
FIG. 1 is a perspective view showing an appearance of a coin depositing and dispensing machine according to the present invention.
Figure 2:
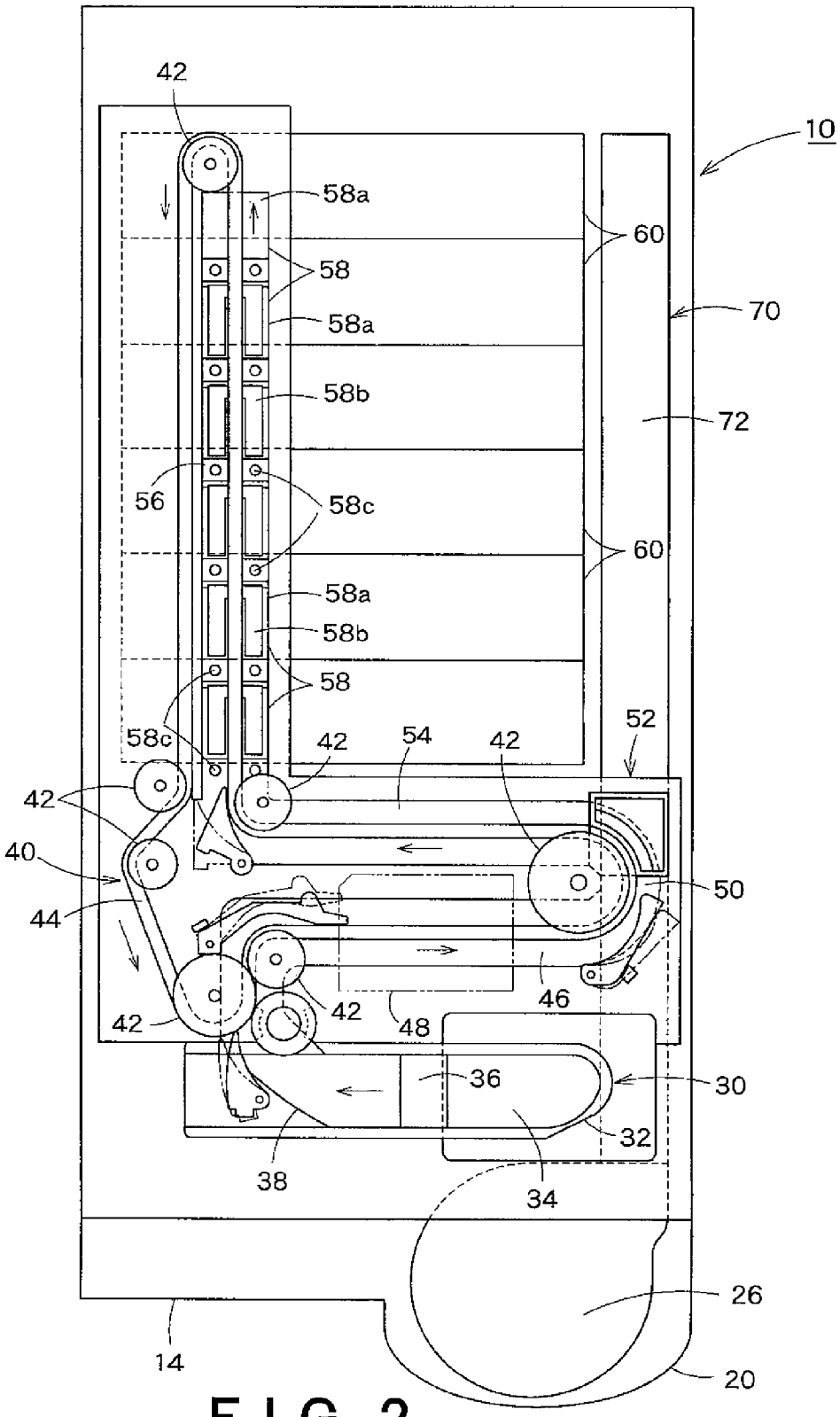
FIG. 2 is a plan view showing an internal structure of the coin depositing and dispensing machine shown in FIG. 1.
Figure 3:
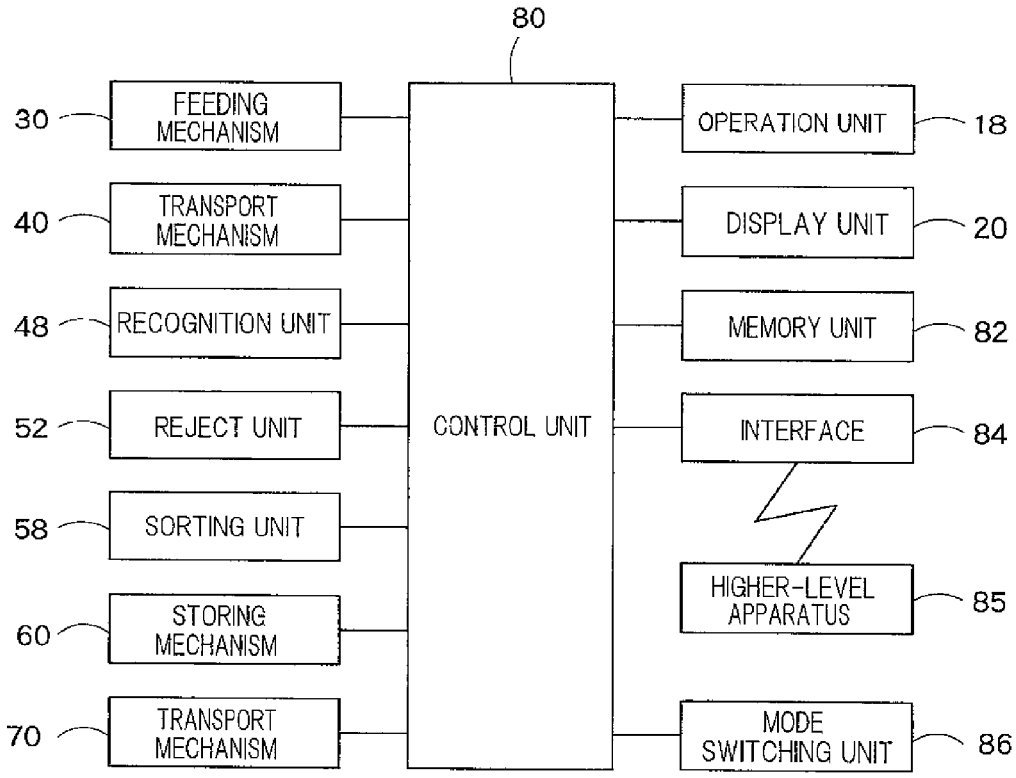
FIG. 3 is a functional block view of the coin depositing and dispensing machine shown in FIGS. 1 and 2.
Figure 4:
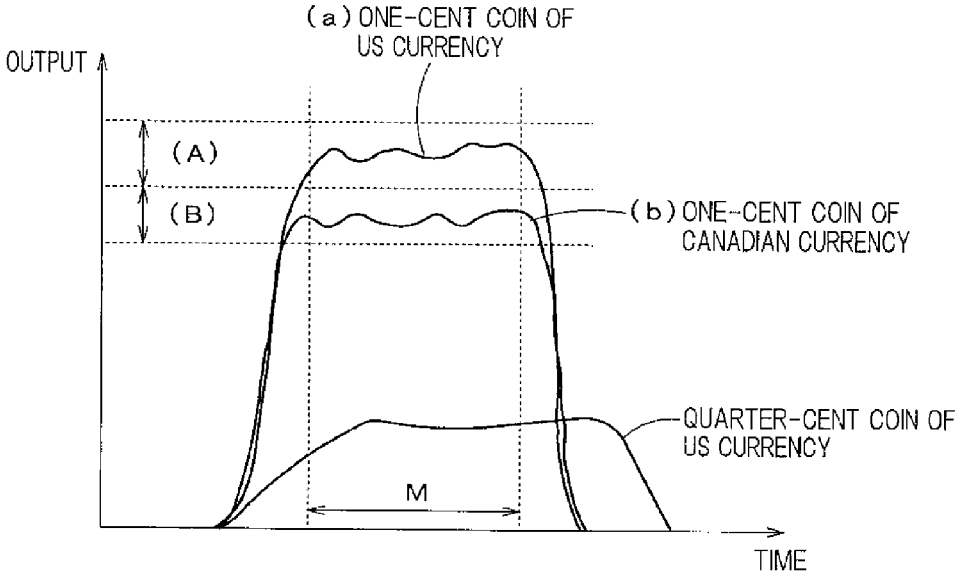
FIG. 4 is an explanatory view showing a feature amount of a coin detected by a recognition unit of the coin depositing and dispensing machine shown in FIG. 1 and so on, in more detail, a graph showing output signal waveforms of magnetic sensors for various kinds of coins.

A first embodiment of the present invention will be described herebelow with reference to the drawings. FIGS. 1 to 4 are views showing a coin depositing and dispensing machine (coin handling apparatus) in this embodiment. FIG. 1 is a perspective view showing an appearance of the coin depositing and dispensing machine according to this embodiment, and FIG. 2 is a plan view showing an internal structure of the coin depositing and dispensing machine shown in FIG. 1. FIG. 3 is a functional block view of the coin depositing and dispensing machine shown in FIGS. 1 and 2, and FIG. 4 is an explanatory view showing a feature amount of a coin detected by a recognition unit of the coin depositing and dispensing machine shown in FIG. 1 and so on, in more detail, a graph showing output signal waveforms of magnetic sensors for various kinds of coins. The coin depositing and dispensing machine 10 shown in FIG. 1 and so on is configured to deposit and dispense coins in a register in a shop by communicating with a POS register, for example.

As shown in FIG. 1, the coin depositing and dispensing machine 10 includes a housing 12 having an opening in a front surface thereof, and a body unit 14 that can be drawn out from the front surface of the housing 12. A coin inlet 16 through which a coin is put into the machine is formed in an upper surface of a front part of the body unit 14 projecting from the housing 12. In addition, in the upper surface of the front part of the body unit 14 projecting from the housing 12, there are provided an operation unit 18 having buttons for operation and setting, and a display unit 20 such as a liquid-crystal display device that displays various information relating to an operation and a setting, and an LED display device that displays a coin storage amount by denomination. Further, a dispense tray 22 is provided on a right lower part of the front surface of the body unit 14. In an upper surface of the dispense tray 22, there is formed a coin outlet 26 to which a coin to be dispensed from the machine is discharged through a coin discharge opening 24.

As shown in FIG. 2, the body unit 14 of the coin depositing and dispensing machine 10 is provided with a feeding mechanism 30 configured to feed, one by one, a coin having been put into the coin inlet 16. The feeding mechanism 30 includes a reception unit 32 disposed below the coin inlet 16 and configured to receive a coin having been put into the coin inlet 16, and a transport belt 34 constituting a bottom surface of the reception unit 32. The transport belt 34 is formed of an endless flat belt, and is configured to transport a coin in a coin feeding direction from the right side toward the left side in FIG. 2. A pathway width on the transport belt 34 is restricted to a size that is larger than a size of a coin having the largest diameter among coins to be handled and is smaller than a size that is twice of a coin having the smallest diameter. In addition, a counter-rotating roller 36 is disposed on a position on a downstream side of the reception unit 32 in the transport direction of the transport belt 34. The counter-rotating roller 36 is located above the transport belt 34 with a slight gap between the counter-rotating roller 36 and the transport belt 34. The size of the gap between the counter-rotating roller 36 and the transport belt 34 is set to allow passage of one coin. The counter-rotating roller 36 is configured to be reversely rotated with respect to the coin feeding direction of the transport belt 34 so as to align coins on the transport belt 34, which are to be fed out in the coin feeding direction (left direction in FIG. 2), into a one-layer and one-row condition.

In addition, the body unit 14 of the coin depositing and dispensing machine 10 includes a transport mechanism 40 configured to transport, one by one, a coin delivered from the transport belt 34. The transport mechanism 40 is formed of an endless transport belt 44 going around a plurality of pulleys 42. The transport belt 44 is provided with projections (not shown) to be engaged with a coin for transporting the coin engaged therewith, with equal intervals therebetween. A guide member 38 is disposed on the downstream side of the counter-rotating roller 36 in the coin feeding direction of the transport belt 34. A coin fed out by the transport belt 34 is transported by the guide member 38 so as to be delivered to the transport mechanism 40. The coin delivered from the transport belt 34 to the transport mechanism 40 is transported by the transport belt 44 to pass through a recognition pathway 46, a reject pathway 50, an intermediate pathway 54 and a sorting pathway 56, in this order. The recognition pathway 46 is provided with a recognition unit 48, and recognition of a coin is performed by the recognition unit 48. The detailed structure of the recognition unit 48 will be described below. The reject pathway 50 has a reject unit 52. A reject coin that has been recognized by the recognition unit 48 as a reject coin is rejected by the reject unit 52. The coin rejected by the reject unit 52 is transported by a transport belt 72, which will be described below, and is returned to the coin outlet 26 through the coin discharge opening 24.

In addition, the body unit 14 of the coin depositing and dispensing machine 10 is provided with a plurality of storing mechanisms 60 configured to store coins by denomination and to feed out a coin stored therein. The sorting pathway 56 has a plurality of sorting units 58 configured to sort coins that are transported by the transport belt 44 by denomination and to store the coins into the respective storing mechanisms 60. As shown in FIG. 2, the respective soring units 58 are disposed correspondingly to the respective storing mechanisms 60. Each of the sorting units 58 has a sorting hole **58*a* through which a coin falls down from the sorting pathway 56. Each of the sorting holes 58*a*, excluding the sorting hole 58 located on the most downstream side in the transport direction, is provided with a sorting gate 58*b*. Each of the sorting gate 58*b* is configured to selectively open the corresponding sorting hole 58*a*. When the sorting hole 58*a* is opened by the sorting gate 58*b*, a coin transported by the transport belt 44 falls down through the soring hole 58*a*, so as to be stored in the storing mechanism 60. In the sorting pathway 56, in order to determine an opening timing and a closing timing of the sorting gate 58*b*, and to confirm sorting of coins into the respective storing mechanisms 60, coin detecting sensors 58*c* configured to detect a coin transported by the transport belt 44 are respectively provided on positions on the upstream side of the respective sorting units 58** in the transport direction.

In addition, the body unit 14 of the coin depositing and dispensing machine 10 is provided with a transport mechanism 70 configured to transport a coin fed out from each storing mechanism 60. The transport mechanism 70 is formed of a transport belt 72. A coin fed out from each storing mechanism 60 is transported, one by one, by the transport belt 72 in the down direction in FIG. 2, so as to be sent to the coin outlet 26 through the coin discharge opening 24.

In the housing 12 of the coin depositing and dispensing machine 10, there is provided a control unit 80 configured to control the respective constituent elements of the coin depositing and dispensing machine 10. The structure of the control unit 80 is described with reference to FIG. 3. As shown in FIG. 3, the control unit 80 is respectively connected to the feeding mechanism 30, the transport mechanism 40, the recognition unit 48, the reject unit 52, the respective sorting units 58, the respective storing mechanisms 60, the transport mechanism 70, the operation unit 18, the display unit 20 and so on. A coin recognition result by the recognition unit 48 is transmitted to the control unit 80. The control unit 80 transmits commands to the feeding mechanism 30, the transport mechanism 40, the reject unit 52, the respective sorting units 58, the respective storing mechanisms 60 and the transport mechanism 70, such that these constituent elements are controlled. Information inputted by an operator through the operation unit 18 is transmitted to the control unit 80. By transmitting information from the control unit 80 to the display unit 20, the display unit 20 displays various information.

In addition, as shown in FIG. 3, a memory unit 82 is connected to the control unit 80. The memory unit 82 is configured to store various setting information of the coin depositing and dispensing machine 10, and storing information such as the number of coins for each denomination which are stored in the respective storing mechanisms 60. Further, an interface 84 is connected to the control unit 80. The control unit 80 can transmit and receive a signal to and from a higher-level apparatus 85 such as a POS terminal, via the interface 84. In this embodiment, a coin handling system is composed of the coin depositing and dispensing machine 10 and the higher-level apparatus 85.

In addition, in the coin depositing and dispensing machine 10 in this embodiment, the control unit 80 is configured to execute any one of two process modes of a first process mode in which a value of a first coin (e.g., a coin of US currency) and a value of a second coin (e.g., a coin of Canadian currency) are handled as an equivalent value, and a second process mode in which the first coin and the second coin are handled in a differentiated manner. To be more specific, in a case where the control unit 80 executes the first process mode, when a coin is processed by the coin depositing and dispensing machine 10, the value of a coin of US currency and the value of a coin of Canadian currency are regarded as an equivalent value. On the other hand, in a case where the control unit 80 executes the second process mode, when a coin is processed by the coin depositing and dispensing machine 10, the value of a coin of US currency and the value of a coin of Canadian currency are regarded to be different from each other.

In addition, as shown in FIG. 3, a mode switching unit 86 is connected to the control unit 80. The mode switching unit 86 is configured to switch the process mode to be executed by the control unit 80 between the first process mode and the second process mode. More particularly, when an operator inputs information that informs which one of the first process mode and the second process mode is executed to process a coin, to the control unit 80 through the operation unit 18, the mode switching unit 86 switches the process mode as to which one of the first process mode and the second process mode is executed by the control unit 80, based on the information inputted by the operator through the operation unit 18.

Next, the details of the recognition unit 48 in the coin depositing and dispensing machine 10 in this embodiment are described. The control unit 48 in this embodiment is structured by, e.g., a magnetic sensor, an image sensor or a diameter sensor, and is configured to detect a feature amount of a coin recognized in the coin recognition operation. For example, in a case where the recognition unit 48 is a magnetic sensor, when a coin is passed through the recognition unit 48 while a sine wave of a predetermined frequency is being applied to a primary coil, an output corresponding to a kind of the coin can be obtained from a secondary coil. By rectifying and smoothing the output of the secondary coil so as to convert the output to a direct-current signal, an output waveform with time can be obtained, which is shown in FIG. 4. A height (output) and a length (width) or the like of the output waveform represent a feature amount of each coin, so that the coin can be recognized. When the recognition unit 48 is an image sensor, a similarity between a template image prepared for each denomination and an image of a coin represents a feature amount.

As shown in FIG. 4, in the case the recognition unit 48 is a magnetic sensor, when a one-cent coin is recognized by the recognition unit 48, a feature amount of a coin detected when the recognition unit 48 recognizes a one-cent coin of US currency (see the graph indicated by the reference character (a) in FIG. 4), and a feature amount of a coin detected when the recognition unit 48 recognizes a one-cent coin of Canadian currency (see the graph indicated by the reference character (b) in FIG. 4) differ from each other.

In a case where the first process mode is executed by the control unit 80, in the coin recognition operation by the recognition unit 48, when a feature amount of the detected coin conforms to feature amount information including the feature amount of a one-cent coin of US currency and the feature amount of a one-cent coin of Canadian currency, the recognized coin is regarded as a one-cent coin of US currency. Specifically, in FIG. 4, when an output within a range of a predetermined time width M is included in one of a range (A) and a range (B), the coin recognized by the recognition unit 48 is regarded as one-cent coin of US currency. In this manner, in a case where the first process mode is executed by the control unit 80, when a one-cent coin of US currency is recognized by the recognition unit 48, the recognized coin is naturally regarded as a one-cent coin of US currency in the recognition unit 48, and even when a one-cent coin of Canadian currency is recognized by the recognition unit 48, the recognized coin is also regarded as a one-cent coin of US currency in the recognition unit 48. In either case, a coin recognition result, which is transmitted from the recognition unit 48 to the control unit 80, is regarded as a one-cent coin of US currency. The same is true with coins of other denominations of US currency and Canadian currency.

On the other hand, in a case where the second process mode is executed by the control unit 80, in the coin recognition operation by the recognition unit 48, even when a feature amount of the detected coin conforms to the feature amount information including the feature amount of a one-cent coin of US currency and the feature amount of a one-cent coin of Canadian currency, not all the recognized coins are regarded as a one-cent coin of US currency. Specifically, in FIG. 4, when an output within a range of the predetermined time width M is included in the range (A), the coin recognized by the recognition unit 48 is regarded as a one-cent coin of US currency. On the other hand when an output within the predetermined time width M is included in the range (B), the coin recognized by the recognition unit 48 is regarded as a one-cent coin of Canadian currency. In this manner, when a one-cent coin of US currency is recognized by the recognition unit 48, the recognized coin is regarded as a one-cent coin of US currency. Meanwhile, when a one-cent coin of Canadian currency is recognized by the recognition unit 48, the recognized coin is regarded as a one-cent coin of Canadian currency. The same is true with coins of other denominations of US currency and Canadian currency.

Figure 5:
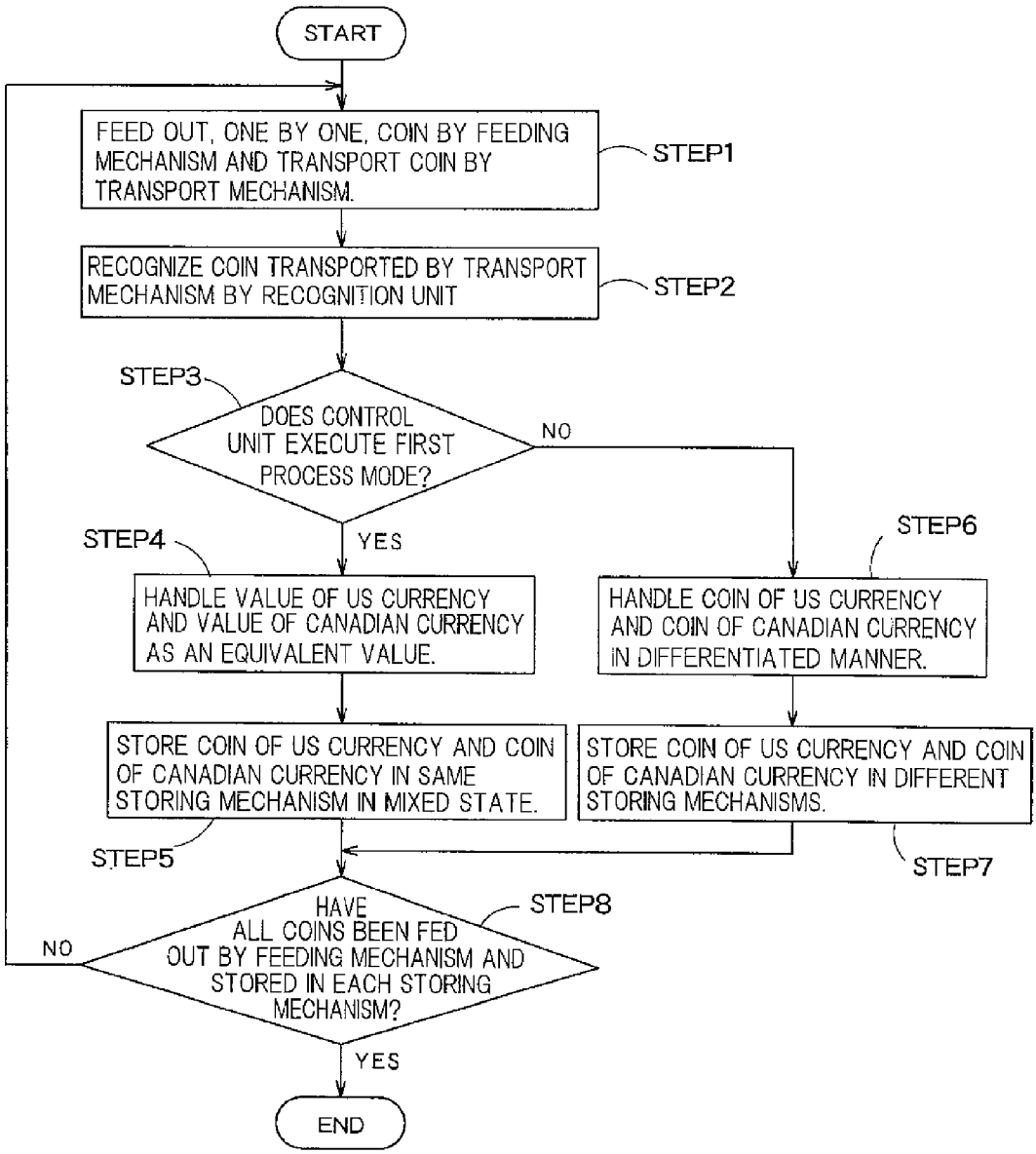
FIG. 5 is a flowchart showing an operation for a coin depositing process performed in the coin depositing and dispensing machine of the present invention.
Figure 6:
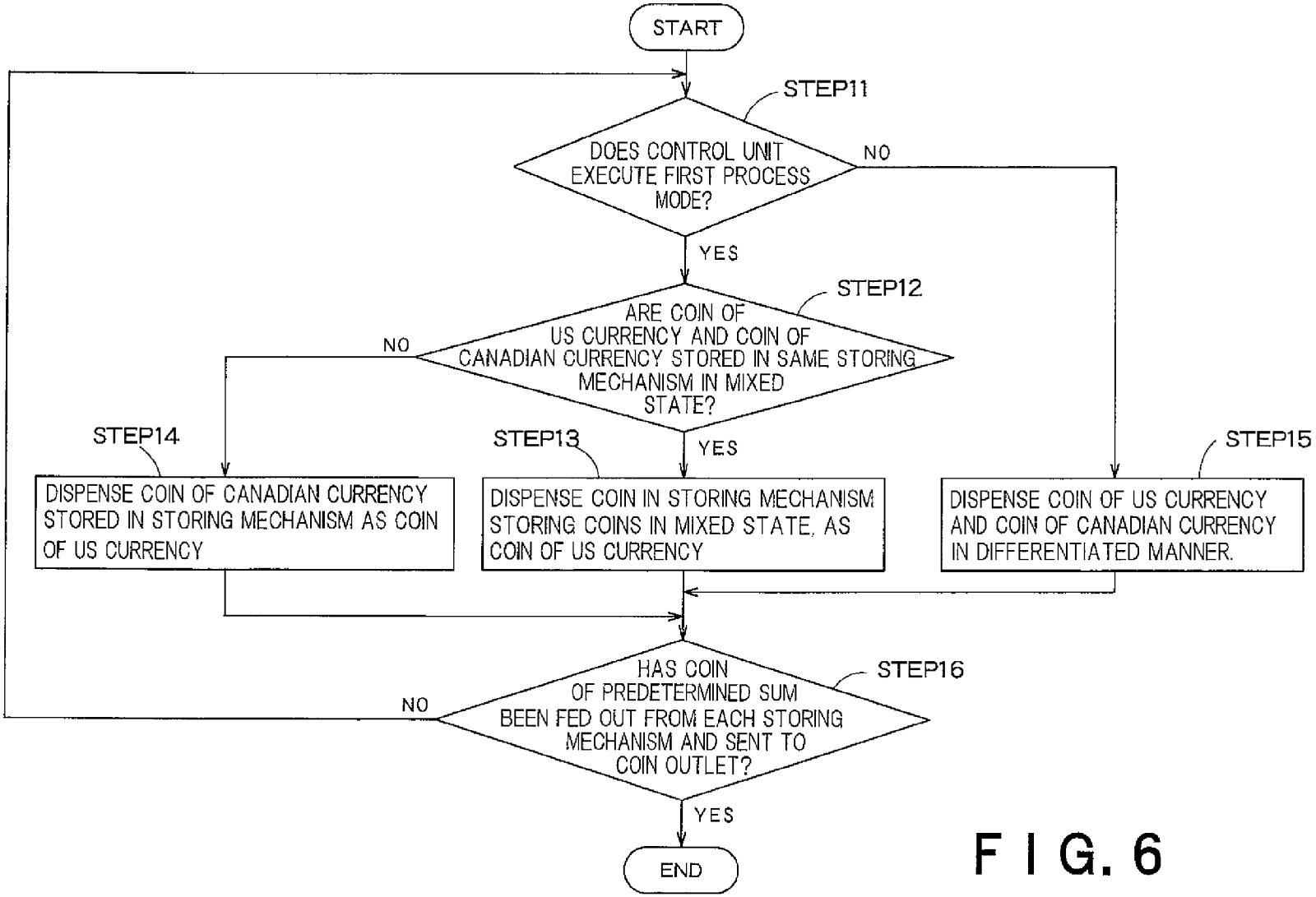
FIG. 6 is a flowchart showing an operation for a coin dispensing process performed in the coin depositing and dispensing machine of the present invention.

Next, an operation of the coin depositing and dispensing machine 10 in this embodiment is described with reference to flowcharts shown in FIGS. 5 and 6. FIG. 5 is the flowchart showing an operation for a coin depositing process performed in the coin depositing and dispensing machine 10, and FIG. 6 is the flowchart showing an operation for a coin dispensing process performed in the coin depositing and dispensing machine 10. The below-described operation of the coin depositing and dispensing machine 10 is performed by the control unit 80 controlling the respective constituent elements of the coin depositing and dispensing machine 10.

Firstly, the operation for performing the coin depositing process in the coin depositing and dispensing machine 10 is described with reference to the flowchart shown in FIG. 5.

In the coin depositing and dispensing machine 10, whether a coin is processed by the first process mode and the second process mode is set in advance by the control unit 80. When an operator intends to switch the process mode to be executed by the control unit 80, the operator inputs information informing that the process mode is switched, to the control unit 80 through the operation unit 18. Then, the mode switching unit 86 switches the process mode executed by the control unit 80.

When the coin depositing process is performed, an operator firstly puts a coin into the body unit 14 through the coin inlet 16. Then, when a command for starting the depositing process is given by the operator to the control unit 80 through the operation unit 18, a coin having been put thereinto is fed out, one by one, by the feeding mechanism 30 and is transported by the transport mechanism 40 (STEP 1). Then, the coin transported by the transport mechanism 40 is recognized by the recognition unit 48, so that a feature amount of the coin is detected (STEP 2).

When the control unit 80 executes the first process mode ("YES" in STEP 3), the value of a coin of US currency and the value of a coin of Canadian currency are handled as an equivalent value (STEP 4). To be more specific, in the coin recognition operation by the recognition unit 48, when a feature amount of the detected coin conforms to the feature amount information including the feature amount of a one-cent coin of US currency and the feature amount of a one-cent coin of Canadian currency the recognized coin is regarded as a one-cent coin of US currency. Thus, when a one-cent coin of US currency is recognized by the recognition unit 48, the recognized coin is naturally regarded as a one-cent coin of US currency in the recognition unit 48, and even when a one-cent coin of Canadian currency is recognized by the recognition unit 48, the recognized coin is also regarded as a one-cent coin of US currency in the recognition unit 48. In either case, a coin recognition result, which is transmitted from the recognition unit 48 to the control unit 80, is regarded as a one-cent coin of US currency. The same is true with coins of other denominations of US currency and Canadian currency.

In both cases in which a one-cent coin of US currency is recognized by the recognition unit 48 and a one-cent coin of Canadian currency is recognized by the recognition unit 48, each of the coin recognition results transmitted from the recognition unit 48 to the control unit 80 is regarded as a one-cent coin of US currency. Thus, the one-cent coin of US currency and the one-cent coin of Canadian currency are stored in the same storing mechanism 60 in a mixed state (STEP 5). The same is true with coins of other denominations of US currency and Canadian currency.

On the other hand, when the control unit 80 does not execute the first process mode ("NO" in STEP 3), i.e., when the control unit 80 executes the second process mode, a coin of US currency and a coin of Canadian currency are handled in a differentiated manner (STEP 6). Namely, in the coin recognition operation by the recognition unit 48, even when a feature amount of the detected coin conforms to the feature amount information including the feature amount of a one-cent coin of US currency and the feature amount of a one-cent coin of Canadian currency, not all the recognized coins are regarded as a one-cent coin of US currency. Thus, when a one-cent coin of US currency is recognized by the recognition unit 48, the recognized coin is regarded as a one-cent coin of US currency. On the other hand, when a one-cent coin of Canadian currency is recognized by the recognition unit 48, the recognized coin is regarded as a one-cent coin of Canadian currency. The same is true with coins of other denominations of US currency and Canadian currency. When the second process mode is executed by the control unit 80, a coin of US currency and a coin of Canadian currency, which have the same denomination, are stored in the different storing mechanisms 60 (STEP 7).

In this manner, until all the coins are fed out by the feeding unit 30 and the coins are stored in the respective storing mechanisms 60 ("NO" in STEP 8), the operation shown in STEPs 1 to 7 of FIG. 5 is repeated. After all the coins have been fed out by the feeding mechanism 30 and the coins have been stored in the respective storing mechanisms 60 ("YES" in STEP 8), the coin depositing process is finished.

Next, the operation for performing the coin dispensing operation in the coin depositing and dispensing machine 10 is described with reference to the flowchart shown in FIG. 6. In the coin dispensing process, in a case where the control unit 80 executes the first process mode ("YES" in STEP 11), when a coin of US currency is dispensed from the coin depositing and dispensing machine 10, a coin of Canadian currency is dispensed as a coin of US currency. More specifically, when a coin of US currency and a coin of Canadian currency, which have the same denomination, are stored in the same storing mechanism 60 in a mixed state ("YES" in STEP 12), the control unit 80 dispenses a coin in the storing mechanism 60 storing coins in a mixed state, as a coin of US currency (STEP 13). More specifically, in the coin depositing process performed in the coin depositing and dispensing machine 10, when the control unit 80 executes the first process mode, a coin of US currency and a coin of Canadian currency, which have the same denomination, are stored in the same storing mechanism 60 in a mixed state. Thus, when the coin dispensing process is performed, a coin (including both a coin of US currency and a coin of Canadian currency) in the storing mechanism 60 storing coins in a mixed state is dispensed as a coin of US currency.

On the other hand, in a case where a coin of US currency and a coin of Canadian currency, which have the same denomination, are stored in the different storing mechanisms 60 ("NO" in STEP 12), when a coin of US currency is dispensed, in addition to a coin in the storing mechanism 60 storing a coin of US currency, a coin in the storing mechanism 60 storing a coin of Canadian currency is dispensed. At this time, the coin in the storing mechanism 60 storing a coin of Canadian currency is dispensed as a coin of US currency (STEP 14). More particularly, when a coin of US currency and a coin of Canadian currency, which have the same denomination, are stored in the different, storing mechanisms 60, a coin in the storing mechanism 60 storing a coin of US currency and a coin in the storing mechanism 60 storing a coin of Canadian currency are dispensed in a mixed state at a suitable ratio therebetween. Specifically, a coin of US currency and a coin of Canadian currency are dispensed in a mixed manner at a predetermined ratio, at a ratio in proportion to the number of coins in the respective storing mechanisms 60, or at a random ratio. In this case, as described above, a coin of Canadian currency is dispensed as a coin of US currency.

On the other hand, when the control unit 80 does not execute the first process mode ("NO" in STEP 11), namely, the control unit 80 executes the second process mode, the control unit 80 dispenses a coin of US currency and a coin of Canadian currency in a differentiated manner (STEP 15).

In this manner, until a coin of a predetermined sum is fed out from the respective storing mechanisms 60 so as to be sent to the coin outlet 26 ("NO" in STEP 16), the operation shown in the STEPs 11 to 15 is repeated. Then, after a coin of the predetermined sum has been fed out from the respective storing mechanisms 60 so as to be sent to the coin outlet 26 ("YES" in STEP 16), the coin dispensing process is finished.

As described above, according to the coin depositing and dispensing machine 10 in this embodiment, there is provided the recognition unit 48 that recognizes a coin and detects a feature amount of the recognized coin. When a feature amount of the detected coin conforms to feature amount information including a feature amount of a first coin (e.g., a coin of US currency) and a feature amount of a second coin (e.g., a coin of Canadian currency), the recognition unit 48 regards the recognized coin as the first coin. Thus, when a coin of US currency and a coin of Canadian currency circulate in a mixed manner on the assumption that the coins have the same value, in the coin depositing and dispensing machine 10, all of a coin of US currency and a coin of Canadian currency, which have been recognized by the recognition unit 48, are regarded as a coin of US currency, without strictly differentiating the coin of US currency and the coin of Canadian currency from each other. Thus, a smooth transaction can be achieved.

More specifically, in a case where a coin of Canadian currency is replaced with a coin of US currency, when a value of a coin of US currency is higher than a value of a coin of Canadian currency of the same denomination as that of coin of US currency, a coin of the nation having a lower value is replaced with a coin of the nation having a higher value. In this case, a store must pay for a difference therebetween. However, in consideration of a management load required for strictly differentiating a coin of US currency and a coin of Canadian currency from each other, an excessive investment can be suppressed, so that the store can obtain a profit significantly higher than the loss of the difference. On the other hand, when a value of a Canadian currency is higher than a coin of US currency of the same denomination as that of the coin of Canadian currency, a coin of the nation having a higher value is replaced with a coin of the nation having a lower value. In this case, a customer must pay for a difference therebetween. However, the difference loss can be balanced out by offering a service, for example, by giving a voucher that can be used in the store when the coin of Canadian currency is paid by the shopper to the store or by giving a reward.

In the coin depositing and dispensing machine 10 in this embodiment, there is provided the mode switching unit 86 that can switch two process modes such that a coin is processed by either one of the process modes of the first process mode in which the value of a coin of US currency and the value of a coin of Canadian currency are handled as an equivalent value, and the second process mode in which a coin of US currency and a coin of Canadian currency are handled in a differentiated manner. Thus, in the coin depositing and dispensing machine 10, it can be easily set whether a coin of US currency and a coin of Canadian currency are handled as coins having the same value, or a coin of US currency and a coin of Canadian currency are strictly differentiated from each other.

In addition, in the coin depositing and dispensing machine 10 in this embodiment, when a coin is stored in the coin depositing and dispensing machine 10, a coin of US currency and a coin of Canadian currency are received such that the coins have an equivalent value. When a coin of US currency is dispensed from the coin depositing and dispensing machine 10, all of a coin dispensed from the storing mechanism 60 storing at least partially a coin of Canadian currency is regarded as a coin of US currency.

The coin depositing and dispensing machine 10 in this embodiment is not limited to the above embodiment, and can be variously modified. For example, in the coin dispensing process, when a coin of US currency and a coin of Canadian currency, which have the same denomination, are stored in the same storing mechanism 60, the higher-level apparatus 85 such as a POS terminal or the like may give a command to the control unit 80 of the coin depositing and dispensing machine 10 via the interface 84, such that a coin in the storing mechanism 60 storing a coin of US currency and a coin in the storing mechanism 60 storing a coin of Canadian currency are dispensed in a mixed manner at a suitable ratio therebetween. Also in this case, a coin of Canadian currency is dispensed as a coin of US currency.

(Second Embodiment)

A second embodiment of the present invention will be described herebelow. In the second embodiment, when a first coin (e.g., a coin of US currency) and a second coin (e.g., a coin of Canadian currency) are recognized, the recognition unit 48 does not regard all the coins as the first coin. Instead, the control unit 80 counts a coin, while regarding all of the first coin and the second coin, which have been recognized by the recognition unit 48, as the first coin. Herebelow, the second embodiment is described, with omitting the same technical matters as those of the aforementioned first embodiment.

In the coin depositing and dispensing machine 10 in the second embodiment, in the coin recognition operation by the recognition unit 48, even when a feature amount of the detected coin conforms to the feature amount information including the feature amount of a coin of US currency and the feature amount of a coin of Canadian currency, not all the recognized coins are regarded as a coin of US currency. Namely, when a coin of US currency is recognized by the recognition unit 48, the recognized coin is regarded as a coin of US currency, but when a coin of Canadian currency is recognized by the recognition unit 48, the recognized coin is regarded as a coin of Canadian currency. Then, a coin recognition result by the recognition unit 48 is transmitted to the control unit 80. When the control unit 80 counts the coins based on the coin recognition result by the recognition unit 48, the control unit 80 counts a coin, while regarding all of the coin of US currency and the coin of Canadian currency, which have been recognized by the recognition unit 48, as a coin of US currency.

Next, an operation of a coin depositing process in the coin depositing and dispensing machine 10 in the second embodiment is described with reference to the flowchart shown in FIG. 5. Description of an operation which is the same as the operation of the coin depositing process in the coin depositing and dispensing machine 10 in the first embodiment is omitted. In addition, since a coin dispensing process in the coin depositing and dispensing machine 10 in the second embodiment is substantially the same as that of the first embodiment, description thereof is omitted.

When the coin depositing process is performed, an operator firstly puts a coin into the body unit 14 through the coin inlet 16. Then, when the operator gives a command for staring the depositing process to the control unit 80 through the operation unit 18, the coin having been put into the body unit 14 is fed out, one by one, by the feeding mechanism 30, and is transported by the transport mechanism 40 (STEP 1). The coin transported by the transport unit 40 is recognized by the recognition unit 48 (STEP 2). At this time, when a coin of US currency is recognized by the recognition unit 48, the recognized coin is regarded as a coin of US currency, but when a coin of Canadian currency is recognized by the recognition unit 48, the recognized coin is regarded as a coin of Canadian currency.

In a case where the control unit 80 executes the first process mode ("YES" in STEP 3), when the control unit 80 counts a coin based on a coin recognition result by the recognition unit 48, the control unit 80 regards all of the coin of US currency and the coin of Canadian currency, which have been recognized by the recognition unit 48, as a coin of US currency. Thus, even when a coin of Canadian currency has been recognized by the recognition unit 48, the control unit 80 counts a coin, while regarding the coin of Canadian currency as a coin of US currency.

In both cases where a coin of US currency is recognized by the recognition unit 48 and a coin of Canadian currency is recognized by the recognition unit 48, the coin of US currency and the coin of Canadian currency, which have the same denomination, are stored in the same storing mechanism 60 in a mixed state (STEP 5). The coin depositing and dispensing machine 10 in the second embodiment is not limited to the above aspect. A coin of US currency recognized by the recognition unit 48 and a coin of Canadian currency recognized by the recognition unit 48, which have the same denomination, may be stored in the different storing mechanisms 60.

On the other hand, when the control unit 80 does not execute the first process mode ("NO" in STEP 3), i.e., when the control unit 80 executes the second process mode, a coin of US currency and a coin of Canadian currency are handled in a differentiated manner (STEP 6). Namely, the control unit 80 counts a coin, while differentiating a coin of US currency and a coin of Canadian currency, which have been recognized by the recognition unit 48, from each other. When the second process mode is executed by the control mode 80, a coin of US currency and a coin of Canadian currency are stored in the different storing mechanisms 60 (STEP 7).

In this manner, until all the coins are fed out by the feeding mechanism 30 and the coins are stored in the respective storing mechanisms 60 ("NO" in STEP 8), the operation shown in STEPs 1 to 7 of FIG. 5 is repeated. Then, after all the coins have been fed out by the feeding mechanism 30 and all the coins have been stored in the respective storing mechanisms 60 ("YES" in STEP 8), the coin depositing process is finished.

As described above, according to the coin depositing and dispensing machine 10 in the second embodiment, when the control unit 80 counts a coin based on a recognition result by the recognition unit 48, the control unit 80 counts a coin, while regarding all of a first coin (e.g., a coin of US currency) and a second coin (e.g., a coin of Canadian currency), which have been recognized by the recognition unit 48, as the first coin. Thus, when a coin of US currency and a coin of Canadian currency circulate in a mixed state on the assumption that the coins have the same value, in the coin depositing and dispensing machine 10, the control unit 80 regards all of a coin of US currency and a coin of Canadian currency, which have been recognized by the recognition unit 48, as a coin of US currency, without strictly differentiating the coin of US currency and the coin of Canadian currency from each other. Thus, a smooth transaction can be achieved.

The coin depositing and dispensing machine 10 in this embodiment is not limited to the above embodiment, and can be variously modified. For example, not the control unit 80 of the coin depositing and dispensing machine 10 but the higher-level apparatus 85 such as a POS terminal, which is connected for communication with the control unit 80 via the interface 84, may count a coin based on a recognition result by the recognition unit 48. In this case, the higher-level apparatus 85 may count a coin, while regarding all of a first coin (e.g. a coin of US currency) and a second coin (e.g., a coin of Canadian currency), which have been recognized by the recognition unit 48, as the first coin.

(Third Embodiment)

A third embodiment of the present invention will be described herebelow. Differently from the first embodiment and the second embodiment, in the third embodiment, there is provided a setting unit 88 (described below) configured to perform a setting such that a value of a first coin (e.g., a coin of US currency) and a value of a second coin (e.g., a coin of Canadian currency) are an equivalent value. When the control unit 80 counts a coin based on a recognition result by the recognition unit 48, the control unit 80 calculates a total value of the first coin and the second coin, which have been recognized by the recognition unit 48, in a currency unit of the first nation (US currency), based on the contents set by the setting unit 88. Herebelow, the third embodiment is described, with omitting the same technical matters as those of the aforementioned first and second embodiments.

Figure 7:
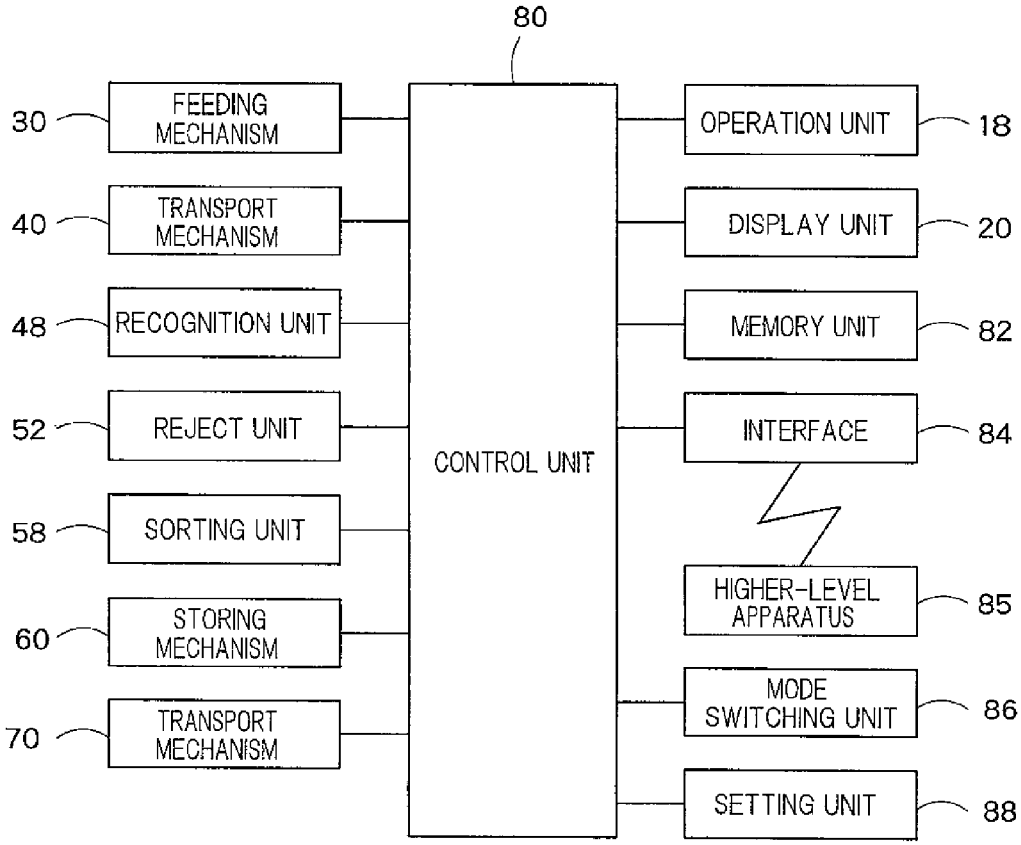
FIG. 7 is a functional block view of the coin depositing and dispensing apparatus according to a third embodiment of the present invention.

As shown in FIG. 7, the setting unit 88 is connected to the control unit 80. The setting unit 88 is configured to perform a setting such that a coin of US currency and a coin of Canadian currency have an equivalent value.

In the coin depositing and dispensing machine 10 in the third embodiment, in the coin recognition operation by the recognition unit 48, even when a feature amount of the detected coin conforms to the feature amount information including the feature amount of a coin of US currency and the feature amount of a coin of Canadian currency, not all the recognized coins are regarded as a coin of US currency. Namely, when a coin of US currency is recognized by the recognition unit 48, the recognized coin is regarded as a coin of US currency, and when a coin of Canadian currency is recognized by the recognition unit 48, the recognized coin is regarded as a coin of Canadian currency. The coin recognition result by the recognition unit 48 is transmitted to the control unit 80. When the control unit 80 counts a coin based on the coin recognition result by the recognition unit 48, the control unit 80 counts a coin, while differentiating the coin of US currency and the coin of Canadian currency, which have been recognized by the recognition unit 48, from each other.

In the coin depositing and dispensing machine 10 in the third embodiment, when the control unit 80 calculates a total sum of coins having been deposited into the coin depositing and dispensing machine 10, the control unit 80 calculates a total sum of a coin of US currency and a coin of Canadian currency in a currency unit of US currency. At this time, the value of a coin of US currency and the value of a coin of Canadian currency are handled as an equivalent value. Specifically, in a case where one hundred one-cent coins of US currency and fifty one-cent coins of Canadian currency are deposited into the coin depositing and dispensing machine 10, when the control unit 80 counts the deposited coins, a count result shows that the number of one-cent coins of US currency is one hundred and the number of one-cent coins of Canadian currency is fifty. However, the control unit 80 judges that a total sum is 150 cents in US currency.

Since a coin depositing process and a coin dispensing process in the coin depositing and dispensing machine 10 in the third embodiment is substantially the same as that of the second embodiment, description thereof is omitted.

As described above, according to the coin depositing and dispensing machine 10 in the third embodiment, there is provided the setting unit 88 configured to perform a setting such that a value of a first coin (e.g., a coin of US currency) and a value of a second coin (e.g., a coin of Canadian currency) are regarded as an equivalent value. When the control unit 80 counts a coin based on a recognition result by the recognition unit 48, the control unit 80 calculates a total value of the first coin and the second coin, which have been recognized by the recognition unit 48, with a currency of the first nation, based on the contents set by the setting unit 88. Thus, when a coin of US currency and a coin of Canadian currency circulate in a mixed manner on the assumption that the coins have the same value, in the coin depositing and dispensing machine 10, a total sum of coins having been deposited is calculated in such a manner that all of a coin of US currency and a coin of Canadian currency, which have been recognized by the recognition unit 48, are regarded as a coin of US currency, without strictly differentiate the coin of US currency and the coin of Canadian currency from each other. Thus, a smooth transaction can be achieved.

The coin depositing and dispensing machine 10 in this embodiment is not limited to the above embodiment, and can be variously modified. For example, not the control unit 80 of the coin depositing and dispensing machine 10 but the higher-level apparatus 85 such as a POS terminal, which is connected for communication with the control unit 80 via the interface 84, may calculate a total value of a coin of US currency and a coin of Canadian currency, which have been recognized by the recognition unit 48, in a currency unit of US currency, based on the contents set by the setting unit 88. In this case, the higher-level apparatus 85 calculates a total sum of a deposited coin, while regarding all of a coin of US currency and a coin of Canadian currency, which have been recognized by the recognition unit 48, as a coin of US currency. Thus, a smooth transaction can be achieved.

Alternatively, the setting unit configured to perform a setting such that a value of a first coin (e.g., a coin of US currency) and a value of a second coin (e.g., a coin of Canadian currency) are regarded as an equivalent value may be provided, not in the coin depositing and dispensing machine 10, but in the higher-level apparatus 85. In this case, the coin depositing and dispensing machine 10 transmits, to the higher-level apparatus 85, recognition results of the first coin and the second coin obtained by the recognition unit 48 in a differentiated manner. The higher-level apparatus 85 calculates a total value of the first coin and the second coin, which have been recognized by the recognition unit 48, in a currency unit of the first nation, based on the contents set by the setting unit disposed in the higher-level apparatus 85. Namely, the higher-level apparatus 85 regards the value of the first coin and the value of the second coin as an equivalent value.

(Modification)

The coin handling machine according to the present invention is not limited to the coin depositing and dispensing machines in the above first to third embodiments. As the coin handing machine according to the present invention, there may be used a coin depositing machine for performing only a coin depositing process, and a coin dispensing machine for performing only a coin dispensing process.

When a coin dispensing machine is used as the coin handing apparatus according to the present invention, when a first coin (e.g., a coin of US currency) is dispensed from the coin dispensing machine, a second coin (a coin of Canadian currency) is dispensed as the first coin. To be more specific, in a case where a coin of US currency and a coin of Canadian currency, which have the same denomination, are stored in the same storing unit in a mixed state, when a coin of US currency is dispensed, all of the coins (i.e., both a coin of US currency and a coin of Canadian currency) in the storing unit are dispensed as a coin of US currency.

In addition, in a case where a coin of US currency and a coin of Canadian currency, which have the same denomination, are stored in the different storing units, when a coin of US currency is dispensed, in addition to a coin in the storing unit storing a coin of US currency, a coin in the storing unit storing a coin of Canadian currency having the same denomination as that of the coin of US currency is dispensed. At this time, a coin of Canadian currency is dispensed as a coin of US currency. More particularly, when a coin of US currency and a coin of Canadian currency are stored in the different storing units, a coin of the storing unit storing a coin of US currency and a coin in the storing unit storing a coin of Canadian currency are dispensed in a mixed manner at a suitable ratio therebetween. Specifically, a coin of US currency and a coin of Canadian currency are dispensed in a mixed manner at a predetermined ratio, at a ratio in proportion to the number of coins in the respective storing mechanisms 60, or at a random ratio.

The invention claimed is:

1. A coin handling apparatus configured to handle a first coin which is a coin of a first nation and a second coin which is a coin of a second nation, the coin handling apparatus comprising:

a recognition unit configured to recognize a coin and to detect a feature amount of the recognized coin, and a control unit configured to regard the recognized coin as the first coin, when the feature amount of the coin detected by the recognition unit conforms to feature amount information including a feature amount of the first coin and a feature amount of the second coin.

2. The coin handling apparatus according to claim 1, further comprising a mode switching unit capable of switching two process modes such that a coin is processed by either one of the process modes of a first process mode in which a value of the first coin and a value of the second coin are handled as an equivalent value, and a second process mode in which the first coin and the second coin are handled in a differentiated manner.

3. A coin handling apparatus configured to handle a first coin which is a coin of a first nation and a second coin which is a coin of a second nation, the coin handling apparatus comprising:

a recognition unit configured to recognize the first coin and the second coin; and a control unit configured to count a coin based on a recognition result by the recognition unit, the control unit being configured to count a coin while regarding all of the first coin and the second coin that have been recognized by the recognition unit as the first coin.

4. The coin handling apparatus according to claim 3, further comprising a mode switching unit capable of switching two process modes such that a coin is processed by either one of the process modes of a first process mode in which a value of the first coin and a value of the second coin are handled as an equivalent value, and a second process mode in which the first coin and the second coin are handled in a differentiated manner.

5. The coin handling apparatus according to claim 3, further comprising a storing unit configured to store a coin, wherein the control unit is configured to perform a control such that, when a coin is stored in the coin handling apparatus, a coin recognized by the recognition unit as the first coin and a coin recognized by the recognition unit as a second coin are stored in the same storing unit in a mixed state.

6. The coin handing apparatus according to claim 3, further comprising a plurality of storing units configured to store coins by denomination, wherein the control unit is configured to perform a control such that, when a coin is stored in the coin handing apparatus, a coin recognized by the recognition unit as the first coin and a coin recognized by the recognition unit as the second coin are stored in the different storing units.

7. A coin handling apparatus configured to handle a first coin which is a coin of a first nation and a second coin which is a coin of a second nation, the coin handling apparatus comprising:

a recognition unit configured to recognize the first coin and the second coin;

a setting unit configured to perform a setting such that a value of the first coin and a value of the second coin are regarded as an equivalent value; and a control unit configured to count a coin based on a recognition result by the recognition result, the control unit being configured to calculate a total value of the first coin and the second coin that have been recognized by the recognition unit in a currency unit of the first nation, based on the contents set by the setting unit.

8. The coin handling apparatus according to claim 7, further comprising a mode switching unit capable of switching two process modes such that a coin is processed by either one of the process modes of a first process mode in which a value of the first coin and a value of the second coin are handled as an equivalent value, and a second process mode in which the first coin and the second coin are handled in a differentiated manner.

9. The coin handling apparatus according to claim 7, further comprising a storing unit configured to store a coin, wherein the control unit is configured to perform a control such that, when a coin is stored in the coin handling apparatus, a coin recognized by the recognition unit as the first coin and a coin recognized by the recognition unit as a second coin are stored in the same storing unit in a mixed state.

10. The coin handing apparatus according to claim 7, further comprising a plurality of storing units configured to store coins by denomination, wherein the control unit is configured to perform a control such that, when a coin is stored in the coin handing apparatus, a coin recognized by the recognition unit as the first coin and a coin recognized by the recognition unit as the second coin are stored in the different storing units.

11. A coin handling apparatus configured to handle a first coin which is a coin of a first nation and a second coin which is a coin of a second nation, the coin handling apparatus comprising:

a dispensing unit configured to dispense a second coin, and a control unit configured to regard the value of the second coin to be equivalent to the value of a first coin, when the second coin is dispensed.

12. A coin handling system comprising:

a coin handling apparatus configured to handle a first coin which is a coin of a first nation and a second coin which is a coin of a second nation; and a higher-level apparatus provided separately from the coin handling apparatus and connected for communication with the coin handling apparatus;

wherein:

the coin handing apparatus includes a recognition unit configured to recognize the first coin and the second coin, and is configured to transmit respective recognition results of the first coin and the second coin obtained by the recognition unit to the higher-level apparatus; and the higher-level apparatus is configured to process a coin while regarding a value of the first coin and a value of the second coin as an equivalent value.

* * * * *